US008362358B2

(12) United States Patent
Hotte et al.

(10) Patent No.: US 8,362,358 B2
(45) Date of Patent: Jan. 29, 2013

(54) ELECTRICAL TRANSMISSION CABLE

(76) Inventors: Ken Hotte, Kingston (CA); Taras Kowalcyzszyn, Kingston (CA)

( * ) Notice: Subject to any disclaimer, the term of this patent is extended or adjusted under 35 U.S.C. 154(b) by 327 days.

(21) Appl. No.: 12/733,718

(22) PCT Filed: Sep. 18, 2008

(86) PCT No.: PCT/CA2008/001633

§ 371 (c)(1),
(2), (4) Date: Mar. 17, 2010

(87) PCT Pub. No.: WO2009/036556

PCT Pub. Date: Mar. 26, 2009

(65) Prior Publication Data

US 2010/0193243 A1 Aug. 5, 2010

Related U.S. Application Data

(60) Provisional application No. 60/960,174, filed on Sep. 19, 2007.

(51) Int. Cl.
*H01B 1/00* (2006.01)

(52) U.S. Cl. ..... 174/9 F; 174/34

(58) Field of Classification Search ..... 174/33, 174/34, 93, 9 F; 381/410
See application file for complete search history.

(56) References Cited

U.S. PATENT DOCUMENTS

| | | | | | |
|---|---|---|---|---|---|
| 3,419,702 | A * | 12/1968 | Piel | 219/211 |
| 3,601,519 | A * | 8/1971 | Wanner et al. | 174/9 F |
| 4,413,304 | A * | 11/1983 | Gerry | 361/253 |
| 4,814,548 | A | 3/1989 | Traversino et al. | |
| 6,140,743 | A * | 10/2000 | Kishima et al. | 310/330 |
| 6,225,563 | B1 | 5/2001 | Poulsen | |
| 6,438,250 | B1 | 8/2002 | Johannet | |
| 6,545,213 | B1 | 4/2003 | Gabriel | |
| 6,583,360 | B1 | 6/2003 | Yudashkin | |
| 7,064,276 | B2 * | 6/2006 | Sakabe et al. | 174/110 R |
| 2004/0055857 | A1 * | 3/2004 | Narasimhan | 200/61.47 |
| 2008/0187391 | A1 * | 8/2008 | Mimken | 403/28 |

* cited by examiner

*Primary Examiner* — Chau Nguyen
(74) *Attorney, Agent, or Firm* — Frank J. Bonini, Jr.; John F. A. Earley, III; Harding, Earley, Follmer & Frailey, P.C.

(57) ABSTRACT

The present invention relates to an electrical transmission device. The device comprises a tube containing a liquid conducting material therein. A first and a second connector element are connected to a first and a second end portion of the tube, respectively, such that the liquid conducting material is contained in the tube in a sealed fashion. The first connector element receives an electrical signal and providing the same to the liquid conducting material for transmission to the second connector element. The second connector element receives the electrical signal from the liquid conducting material and provides the received electrical signal. The electrical signal provided by the second connector element has substantially a same phase coherence than the electrical signal received at the first connector element.

20 Claims, 4 Drawing Sheets

ELECTRICAL TRANSMISSION CABLE

CROSS-REFERENCE TO RELATED APPLICATIONS

This is a national stage application of International Application No. PCT/CA2008/01633 filed Sep. 18, 2008, which claims the benefit of U.S. Provisional Application No. 60/960,174 filed Sep. 19, 2007, now abandoned.

FIELD OF THE INVENTION

This invention relates to the field of electrical transmission cables and in particular to an electrical transmission cable that substantially preserves a phase coherence of a signal transmitted therethrough.

BACKGROUND

In modern high-end audio and home theater systems audio cables—interconnect cables, used to connect various components such as a CD player and an amplifier and loudspeaker cables, used to connect loudspeakers to the amplifier—are playing a major role, substantially affecting the listening experience of audiophiles and, therefore, the overall performance of the high-end system. As a result, the manufacture of high-end audio cables has developed into a multi-million dollar per year industry.

Using state of the art electrical engineering knowledge of transmission-line characteristics and, in particular, LRC—inductance, resistance, and capacitance—values of cables it is impossible to explain that an experienced listener is able to perceive differences in the listening experience when listening to a same high-end audio system but using different audio cables for connecting the various components.

However, it is known that an experienced listener is able to perceive very subtle distortions of the phase coherence of an audio signal, which is caused by very subtle phase shift effects experienced by high frequency components of an audio signal while traveling through the cable affecting the harmonics and the envelope of the waveform of the audio signal.

Numerous attempts have been made in order to minimize the effects of the cable on the phase coherence of the transmitted audio signal using, for example, different shapes such as "flat ribbon" cables and different materials such as "oxygen free copper" and silver. Unfortunately, while improvements have been achieved there is still a need for reducing the effects of the audio cable on the phase coherence of the transmitted audio signal.

It would be desirable to provide an electrical transmission cable that substantially preserves the phase coherence of the signal transmitted therethrough.

SUMMARY OF EMBODIMENTS OF THE INVENTION

In accordance with an aspect of the present invention there is provided an electrical transmission device comprising:

a tube containing a liquid conducting material therein; and, a first and a second connector element connected to a first and a second end portion of the tube, respectively, such that the liquid conducting material is contained in the tube in a sealed fashion, the first connector element for receiving an electrical signal and providing the electrical signal to the liquid conducting material for transmission to the second connector element, the second connector element for receiving the electrical signal from the liquid conducting material and for providing the received electrical signal, wherein in operation the electrical signal provided by the second connector element has a substantially same phase coherence than the electrical signal received at the first connector element.

In accordance with an aspect of the present invention there is further provided an electrical phase shifting device comprising:

a tube containing a liquid conducting material therein;

at least a wire disposed in the liquid conducting material; and, a first and a second connector element connected to a first and a second end portion of the tube, respectively, such that the liquid conducting material is contained in the tube in a sealed fashion, the first and the second connector element being connected to a first and a second end portion of the at least a wire, the first connector element for receiving an electrical signal and providing the electrical signal to the liquid conducting material and the wire for transmission to the second connector element, the second connector element for receiving the electrical signal from the liquid conducting material and the wire and for providing the received electrical signal, wherein in operation a phase coherence of the electrical signal has been changed in a predetermined fashion.

In accordance with an aspect of the present invention there is yet further an electrical phase shifting device comprising:

a tube containing a liquid conducting material therein;

a plurality of solid particles disposed in the liquid conducting material;

a first and a second connector element connected to a first and a second end portion of the tube, respectively, such that the liquid conducting material is contained in the tube in a sealed fashion, the first connector element for receiving an electrical signal and providing the electrical signal to the liquid conducting material for transmission to the second connector element, the second connector element for receiving the electrical signal from the liquid conducting material and for providing the received electrical signal, wherein in operation a phase coherence of the electrical signal has been changed in a predetermined fashion.

BRIEF DESCRIPTION OF THE FIGURES

Exemplary embodiments of the invention will now be described in conjunction with the following drawings, in which.

DETAILED DESCRIPTION OF EMBODIMENTS OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

An audio signal is electronically encoded in the form of a rapidly time varying voltage which—ideally—directly corresponds to the time varying sound signal of an acoustic event. This time varying voltage produces corresponding electromagnetic waves that propagate through a conductive metal wire of an audio cable causing displacement of electrons in the metal wire. High frequency components of the audio signal cause a rapid displacement of the electrons and as a result interactions of the rapidly displaced electrons with the atoms of the metal wire cause a phase shift distorting the phase coherence of the audio signal.

Applicant has found that use of a liquid conducting material such as, for example, a liquid alloy for transmitting the audio signal substantially reduces the phase shift experienced by the high frequency components of the audio signal and, therefore, substantially preserves the phase coherence of the transmitted audio signal.

While, for the sake of simplicity, the various embodiments of the electrical transmission cable according to the invention will be described in relation to the transmission of analog audio signals, it will become apparent to those skilled in the art that the invention is not limited thereto, but is also beneficial in various other applications where phase coherence of the transmitted signal is of importance, for example in transmission of video signals and digital signals such as high frequency multiplexed digital signals.

Figure 1A:
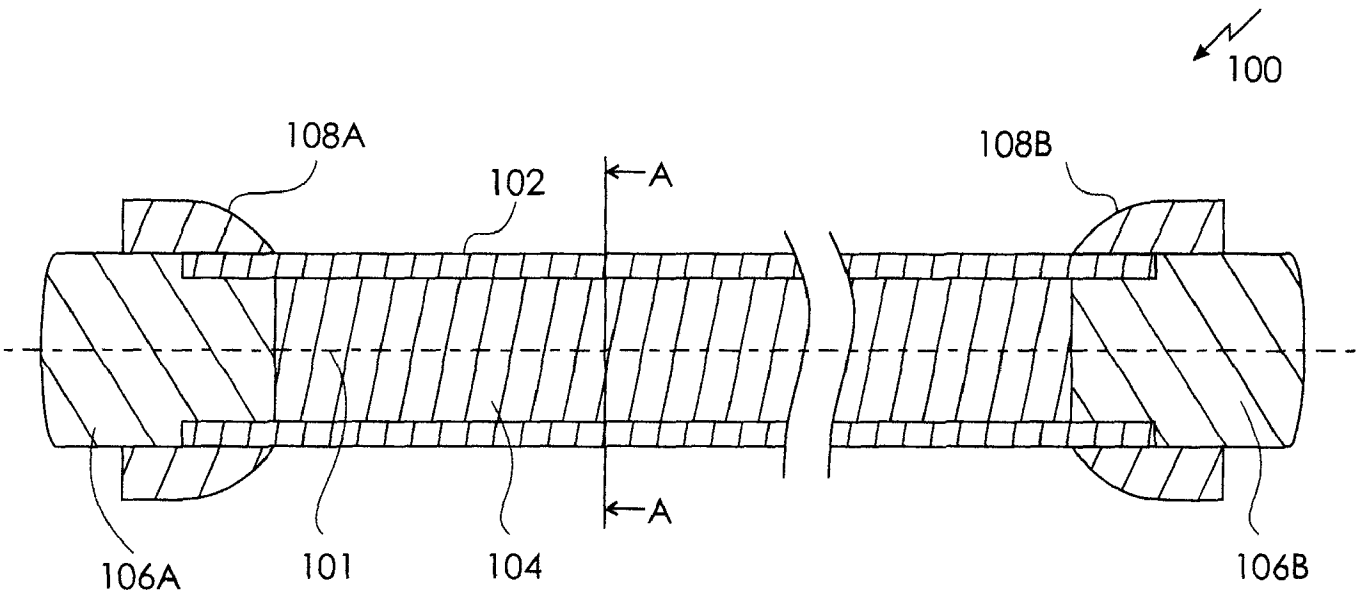
FIGS. 1*a* and 1*b* are simplified block diagrams of an electrical transmission cable according to an embodiment of the invention.
Figure 1B:
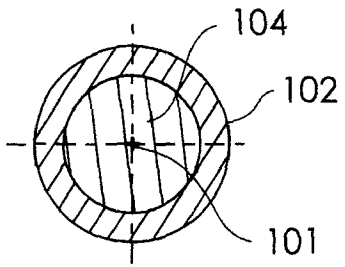

Referring to FIGS. 1*a* and 1*b*, simplified block diagrams of an electrical transmission cable 100 according to an embodiment of the invention are shown, with FIG. 1*a* illustrating a cross sectional view along a longitudinal axis 101 of the electrical transmission cable 100, and FIG. 1*b* illustrating a cross sectional view perpendicular to the longitudinal axis 101. The electrical transmission cable 100 comprises a tube 102 containing a liquid conducting material 104 therein. The liquid conducting material 104 is contained in the tube 102 in a sealed fashion by connector elements 106A and 106B, which form, for example, together with housings 108A and 108B, respectively, connector plugs for mating the electrical transmission cable 100 with respective ports of components of an audio system. The liquid conducting material 104 is contained such that it is in contact with the connector elements 106A and 106B for transmission of an electrical signal to and from the liquid conducting material 104. In operation, an electrical signal is, for example, coupled via the connector element 106A into the liquid conducting material 104, transmitted via the liquid conducting material 104, and then coupled to the connector element 106B.

There are various liquid conducting materials available for use with the electrical transmission cable 100, that are in a liquid phase in a predetermined operating temperature range of the electrical transmission cable 100 such as, for example, room temperature −20° C.±15° C. A variety of eutectic alloys are in the liquid phase at various different temperature ranges. GALINSTAN™, for example, is a eutectic alloy composed of gallium, indium, and tin, which has a melting point of −19° C. and a boiling point of >1300° C. GALINSTAN™ is widely used as mercury replacement in thermometers and, therefore, readily available. Optionally, non-eutectic alloys are employed. Further optionally, non-metallic liquid conducting materials are employed.

The tube 102 is made, for example, of a flexible plastic material such as, for example, TEFLON™ or Fluorinated Ethylene Propylene (FEP). Alternatively, the tube 102 is made of a rigid plastic material or metal. While in FIG. 1*b* an internal cross section of circular shape of the tube 102 is shown, it is also possible to use other shapes for the internal cross section of the tube 102 such as for example, square-shape, star-shape, or ellipse-shape. However, it is possible that such shapes induce a phase shift and, therefore, the shape is determined such that the phase shift is minimized or a predetermined phase shift is obtained.

The connector elements 106A and 106B are made of an electrically conductive material, for example, a solid metal, for transmitting the electrical signal and for coupling the same to and from the liquid metal 104. For example, in order to prevent a chemical reaction of the connector element material with the liquid metal 104, a metal such as, for example, silver or gold is used. Another function of the connector elements 106A and 106B is to seal the liquid metal 104 inside the tube 102. This is achieved, for example, by providing a tight fit between an end portion of the tube 102 and a portion of the connector element 106A, 106B inserted into the tube 102. Alternatively, an adhesive is used to provide a seal between the end portion of the tube 102 and the connector element 106A, 106B.

Figure 2:
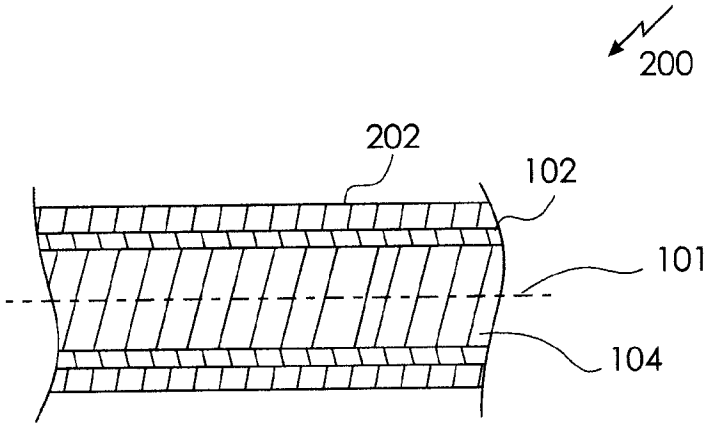
FIG. 2 is a simplified block diagram of another electrical transmission cable according to an embodiment of the invention.

Optionally, the tube 102 is surrounded with a mechanical dampening material 202, as shown in the embodiment 200 of FIG. 2. There are various materials available that provide a mechanical dampening effect such as, for example, VECTRAN™.

Figure 3A:
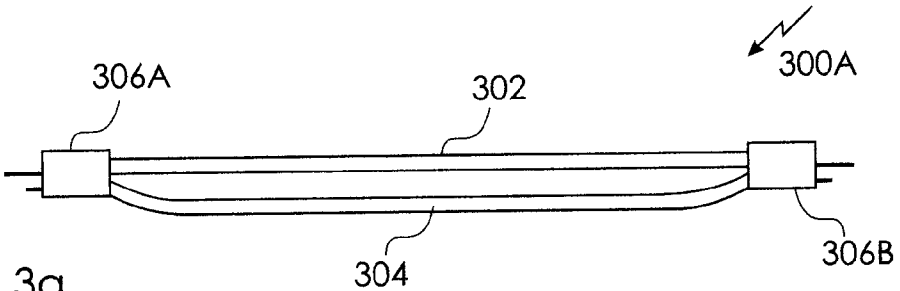
FIGS. 3*a* and 3*b* are simplified block diagrams of yet other electrical transmission cables according to embodiments of the invention.
Figure 3B:
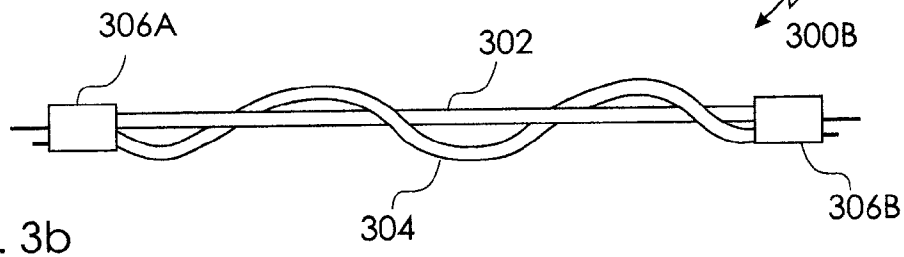

There are numerous possibilities to provide an electrical transmission cable comprising a plurality of pathways, for example, a plurality of pathways for transmitting different electrical signals or a pathway for transmitting an electrical signal and a pathway for providing a ground connection. Referring to FIGS. 3*a* and 3*b*, electrical transmission cables 300A and 300B are shown, respectively, comprising a first pathway 302 for transmitting an electrical signal and a second pathway for providing a ground connection between connector elements 306A and 306B. The first pathway 302 comprises a tube containing a liquid metal for transmitting the electrical signal as shown in FIGS. 1*a* and 1*b* above, while the second pathway 304 comprises either a solid conducting material or a liquid conducting material. The second pathway 304 is disposed parallel to the first pathway 302, as shown in FIG. 3*a*, or wound around the first pathway 302, as shown in FIG. 3*b*. Optionally, the first pathway is surrounded with a mechanical dampening material as disclosed above or both pathways are surrounded with a mechanical dampening material or, alternatively, both pathways are together surrounded with the mechanical dampening material.

Figure 4A:
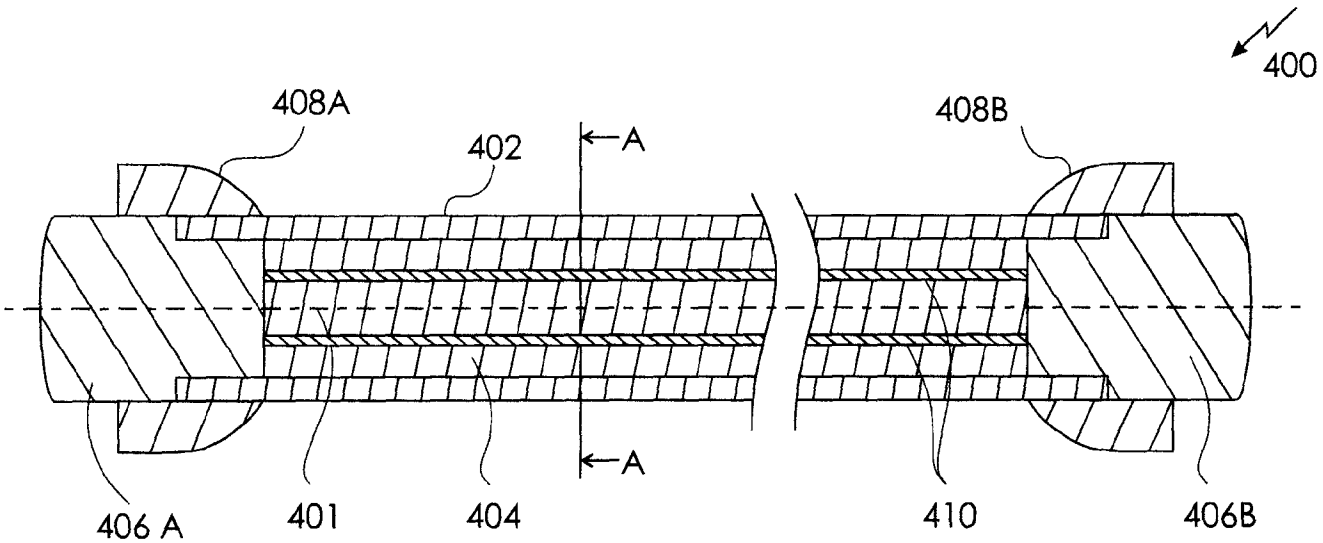
FIGS. 4*a* and 4*b* are simplified block diagrams of an electrical phase shifting device according to an embodiment of the invention; and, FIG. 5 is a simplified block diagram of another electrical phase shifting device according to an embodiment of the invention.
Figure 4B:
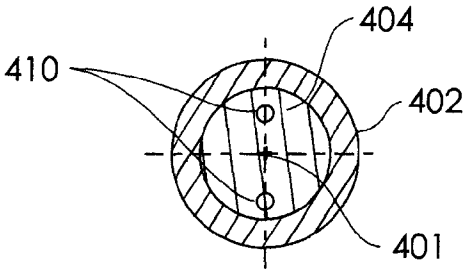

Referring to FIGS. 4*a* and 4*b*, simplified block diagrams of an electrical phase shifting device 400 according to an embodiment of the invention are shown, with FIG. 4*a* illustrating a cross sectional view along a longitudinal axis 401 of the electrical phase shifting device 400, and FIG. 4*b* illustrating a cross sectional view perpendicular to the longitudinal axis 401. The electrical phase shifting device 400 comprises a tube 402 containing a liquid conducting material 404 therein. The liquid conducting material 404 is contained in the tube 402 in a sealed fashion by connector elements 406A and 406B, which form, for example, together with housings 408A and 408B, respectively, connector plugs. Disposed in the tube 402 are wires 410 made of a solid metal—alloy or substantially pure element such as, for example, silver—and connected to the connector elements 406A and 406B. Different impedances of the liquid conducting material 404 and the material of the wires 410 in combination with the geometry of the tube 402 and the wires 410 cause frequency dependent phase shifts acting on an electrical signal transmitted therethrough. Depending on the liquid conducting material 404, the material of the wires 410, the inner dimensions of the tube 402, the inner cross sectional shape of the tube 402, the number, location, cross sectional size, and shape of the wires 410, the electrical phase shifting device 400 is designed such that the phase coherence of an electrical signal transmitted therethrough is changed in a predetermined fashion.

Figure 5:
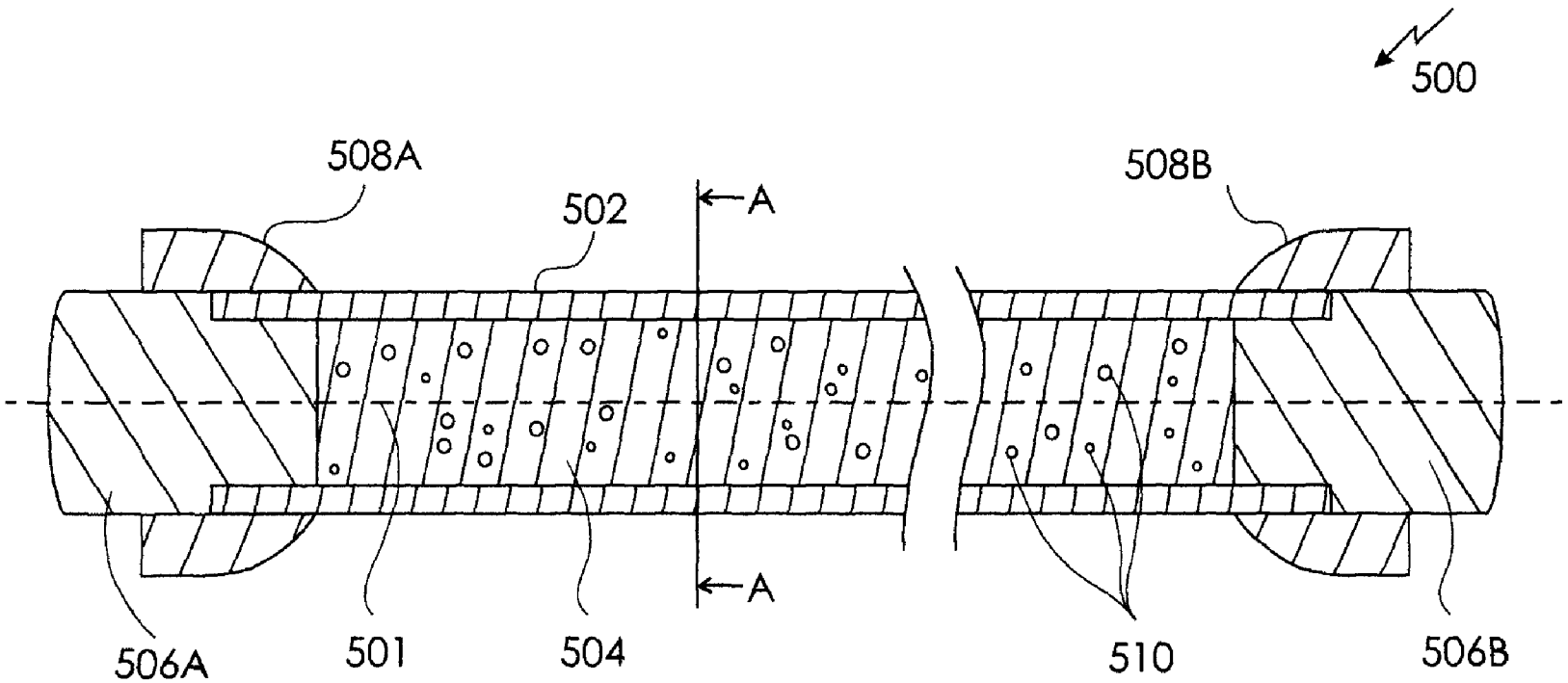

Referring to FIG. 5, a simplified block diagram of an electrical phase shifting device 500 according to an embodiment of the invention is shown. The electrical phase shifting device 500 comprises a tube 502 containing a liquid conducting material 504 therein. The liquid conducting material 504 is contained in the tube 502 in a sealed fashion by connector elements 506A and 506B, which form, for example, together with housings 508A and 508B, respectively, connector plugs. Different impedances of the liquid conducting material 504 and the material of the particles 510 in combination with the geometry of the tube 502 and the number, size, and shape of the particles 510 cause frequency dependent phase shifts acting on an electrical signal transmitted therethrough. Disposed in the liquid conducting material 504 are particles 510 of a solid material or a combination of particles of different solid materials. The particles 510 are, for example, micro-to-nano sized particles of a substantially same size or a combination of different sizes. Depending on the liquid conducting material 504, the material of the particles 510, the inner dimensions of the tube 502, the inner cross sectional shape of the tube 502, the number, size, and shape of the particles 510, the electrical phase shifting device 500 is designed such that the phase coherence of electrical signals transmitted therethrough is changed in a predetermined fashion.

Optionally, the electrical transmission cable as well as the electrical phase shifting device according to embodiments of the invention are operated with an AC or DC biasing current/voltage, for example, to "warm up" the cable or device to a predetermined operating temperature.

Numerous other embodiments of the invention will be apparent to persons skilled in the art without departing from the scope of the invention as defined in the appended claims.

What is claimed is:

1. An electrical transmission device comprising:

a tube containing a liquid conducting material therein;

a first and a second connector element connected to a first and a second end portion of the tube, respectively, such that the liquid conducting material is contained in the tube in a sealed fashion, the first connector element for receiving an electrical signal and providing the electrical signal to the liquid conducting material for transmission to the second connector element, the second connector element for receiving the electrical signal from the liquid conducting material and for providing the received electrical signal; and a second pathway for transmitting a second electrical signal.

2. An electrical transmission device as defined in claim 1 wherein the second pathway is made of a solid conducting material.

3. An electrical transmission device as defined in claim 2 wherein the second pathway is for being connected to ground.

4. An electrical transmission device as defined in claim 1 wherein the liquid conducting material is a liquid alloy.

5. An electrical transmission device as defined in claim 4 wherein the liquid alloy is a eutectic alloy.

6. An electrical transmission device as defined in claim 5 wherein the alloy comprises gallium, indium and tin.

7. An electrical transmission device as defined in claim 1 comprising a mechanical dampening material surrounding the tube.

8. An electrical transmission device as defined in claim 1 wherein the tube, the liquid conducting material the first connector element, and the second connector element are designed such that in operation the electrical signal provided by the second connector element has a substantially same phase coherence as the electrical signal received at the first connector element.

9. An electrical transmission device as defined in claim 1 comprising at least a wire disposed in the liquid conducting material and connected to the first and second connector element.

10. An electrical transmission device as defined in claim 9 wherein the tube, the liquid conducting material, the first connector element, the second connector element, and the at least a wire are designed such that in operation a phase coherence of the electrical signal has been changed in a predetermined fashion.

11. An electrical transmission device as defined in claim 1 comprising a plurality of solid particles disposed in the liquid conducting material.

12. An electrical transmission device comprising:

a tube containing a liquid conducting material therein; and a first and a second connector element connected to a first and a second end portion of the tube, respectively, such that the liquid conducting material is contained in the tube in a sealed fashion, the first connector element for receiving an electrical signal and providing the electrical signal to the liquid conducting material for transmission to the second connector element, the second connector element for receiving the electrical signal from the liquid conducting material and for providing the received electrical signal;

wherein the liquid conducting material is a liquid alloy; and wherein the liquid alloy is a eutectic alloy.

13. An electrical transmission device as defined in claim 12 comprising a second pathway for transmitting a second electrical signal.

14. An electrical transmission device as defined in claim 12 wherein the alloy comprises gallium, indium and tin.

15. An electrical transmission device as defined in claim 12 wherein the tube, the liquid conducting material the first connector element, and the second connector element are designed such that in operation the electrical signal provided by the second connector element has a substantially same phase coherence as the electrical signal received at the first connector element.

16. An electrical transmission device as defined in claim 12 comprising at least a wire disposed in the liquid conducting material and connected to the first and second connector element.

17. An electrical transmission device as defined in claim 16 wherein the tube, the liquid conducting material, the first connector element, the second connector element, and the at least a wire are designed such that in operation a phase coherence of the electrical signal has been changed in a predetermined fashion.

18. An electrical transmission device comprising:

a tube containing a liquid conducting material therein;

a first and a second connector element connected to a first and a second end portion of the tube, respectively, such that the liquid conducting material is contained in the tube in a sealed fashion, the first connector element for receiving an electrical signal and providing the electrical signal to the liquid conducting material for transmission to the second connector element, the second connector element for receiving the electrical signal from the liquid conducting material and for providing the received electrical signal; and a plurality of solid particles disposed in the liquid conducting material.

19. An electrical transmission device as defined in claim 18 wherein the tube, the liquid conducting material, the first connector element, the second connector element, and the plurality of solid particles are designed such that in operation a phase coherence of the electrical signal has been changed in a predetermined fashion.

20. An electrical transmission device as defined in claim 18 comprising a second pathway for transmitting a second electrical signal.

* * * * *